US010788259B1

(12) United States Patent
Tomlinson et al.

(10) Patent No.: US 10,788,259 B1
(45) Date of Patent: Sep. 29, 2020

(54) MODULAR, MOBILE AND SCALABLE LNG PLANT

(71) Applicant: CHESTER LNG LLC, Moon, PA (US)

(72) Inventors: Neville A. Tomlinson, Mitchellville, MD (US); Andrew H. Stern, Greensburg, PA (US); Jerry L. Penland, Ambridge, PA (US)

(73) Assignee: CHESTER LNG, LLC, Pittsburgh, PA (US)

( * ) Notice: Subject to any disclaimer, the term of this patent is extended or adjusted under 35 U.S.C. 154(b) by 160 days.

(21) Appl. No.: 15/367,804

(22) Filed: Dec. 2, 2016

Related U.S. Application Data

(60) Provisional application No. 62/262,970, filed on Dec. 4, 2015.

(51) Int. Cl.
*F25J 1/02* (2006.01)
*F25J 1/00* (2006.01)

(52) U.S. Cl.
CPC ..... *F25J 1/0022* (2013.01); *F25J 1/0204* (2013.01); *F25J 1/0225* (2013.01); *F25J 1/0262* (2013.01); *F25J 1/0275* (2013.01); *F25J 2205/02* (2013.01); *F25J 2205/64* (2013.01); *F25J 2205/84* (2013.01); *F25J 2210/60* (2013.01); *F25J 2220/64* (2013.01); *F25J 2220/66* (2013.01); *F25J 2220/68* (2013.01); *F25J 2240/40* (2013.01); *F25J 2245/02* (2013.01); *F25J 2245/90* (2013.01); *F25J 2270/60* (2013.01); *F25J 2270/906* (2013.01); *F25J 2290/12* (2013.01); *F25J 2290/70* (2013.01)

(58) Field of Classification Search
CPC ..... F25J 1/0204; F25J 1/0205; F25J 1/0225; F25J 1/0262; F25J 1/0275; F25J 2205/02; F25J 2205/64; F25J 2205/84; F25J 2210/60; F25J 2220/64; F25J 2220/66; F25J 2270/906
See application file for complete search history.

(56) References Cited

U.S. PATENT DOCUMENTS 6,041,620 A * 3/2000 Olszewski ..... C09K 5/045 62/612
6,158,241 A 12/2000 Erickson
6,220,053 B1 * 4/2001 Hass, Jr. ..... F25J 1/0015 62/613
6,751,984 B2 6/2004 Neeraas et al.
8,286,431 B2 10/2012 Briesch et al.
(Continued)

*Primary Examiner* — Brian M King
(74) *Attorney, Agent, or Firm* — Reed Smith LLP

(57) ABSTRACT

A system for the production of liquefied natural gas from raw natural gas. The system includes a pre-treatment module to remove impurities from a raw natural gas input, a gas compression module to compress gas received from the pre-treatment module, an absorption chiller for providing gas equipment cooling in the compression module, and a gas liquefaction module including a gas pre-cooler configured to pre-cool gas received from the compression module using a closed-loop refrigeration cycle and a six-stream heat exchanger unit configured to cool gas received from the gas pre-cooler. A power module is provided that powers the pre-treatment module, gas compression module, and gas liquefaction module.

11 Claims, 7 Drawing Sheets

(56) References Cited

U.S. PATENT DOCUMENTS

| | | | | |
|---|---|---|---|---|
| 2006/0213222 | A1* | 9/2006 | Whitesell | F25J 1/0202 62/612 |
| 2007/0251266 | A1* | 11/2007 | Ino | F25B 9/06 62/613 |
| 2009/0113928 | A1* | 5/2009 | Vandor | F25J 1/0022 62/612 |
| 2009/0226308 | A1* | 9/2009 | Vandor | F01D 15/005 415/178 |
| 2010/0275648 | A1* | 11/2010 | Mazumder | F01K 23/068 62/645 |
| 2013/0263624 | A1 | 10/2013 | Vandor | |
| 2014/0260416 | A1* | 9/2014 | McAlister | F25J 1/0007 62/608 |
| 2015/0033793 | A1* | 2/2015 | Griffiths | F25J 1/0045 62/611 |

* cited by examiner

| LABEL | PARAMETER | DESCRIPTION |
|---|---|---|
| G0 | GAS | PLANT MAIN RAW GAS FEED |
| G1 | GAS | PSA MODULE RAW GAS INPUT |
| G2 | GAS | PSA MODULE TREATED GAS OUTPUT |
| G3 | GAS | HIGH PRESSURE GAS TO LIQUEFACTION MODULE |
| G4 | GAS | PSA REJECT GAS TO GAS ENGINE POWER UNIT |
| G5 | GAS | RECYCLED GAS FROM TURBO EXPANDER |
| G6 | GAS | RECYCLED REFRIGERATION LNG FROM PROCESS HEAT EXCHANGER |
| G7 | GAS | RECYCLED FLASH GAS FROM FLASH SEPARATOR TO GAS ENGINE |
| G8 | GAS | BOG FROM STORAGE AND FLASH GAS FROM FLASH SEPARATOR |
| | | TO RECYCLE GAS COMPRESSOR |
| G9 | GAS | MAKE-UP GAS SUPPLY TO GAS ENGINE POWER UNIT |
| G10 | GAS | PSA REJECT GAS TO CHILLER WHEN GAS ENGINE IS NOT PROVIDED. |
| G11 | GAS | BOG GAS FROM STORAGE TANK |
| G12 | GAS | MAKE-UP GAS TO CHILLER WHEN GAS ENGINE IS NOT PROVIDED |
| G13 | GAS | MAKE-UP GAS TO CHILLER WHEN GAS ENGINE IS NOT PROVIDED. |
| L1 | LIQ | LNG PRODUCED FROM LIQUEFACTION PROCESS |
| L2 | LIQ | LNG PRODUCT SENT TO STORAGE TANK VIA GRAVITY FEED |
| L3 | LIQ | LNG PRODUCT SENT TO STORAGE TANK VIA LNG CANNED PUMP |
| L4 | LIQ | LNG PRODUCT SEND-OUT FOR HANDLING AND DISPENSING |
| P1 | ELECT | ENERGY REQ'MT - PSA MODULE |
| P2 | ELECT | ENERGY REQ'MT - COMPRESSION MODULE |
| P3 | ELECT | ENERGY REQ'MT - LIQUEFACTION MODULE |
| P4 | ELECT | ENERGY REQ'MT - LNG STORAGE AND LOADOUT AREA |
| H6 | HEAT | ENERGY REQ'MT - HOT EXHAUST GAS FROM GAS ENGINE TO CHILLER |
| C1 | COOLANT | CHILLED WATER TO POST AFTERCOOLER |
| C2 | COOLANT | CHILLED WATER TO LIQUEFACTION MODULE GAS PRE-COOLER |
| C3 | COOLANT | CHILLED WATER TO COMPRESSOR OIL COOLER |

FIGURE 7B

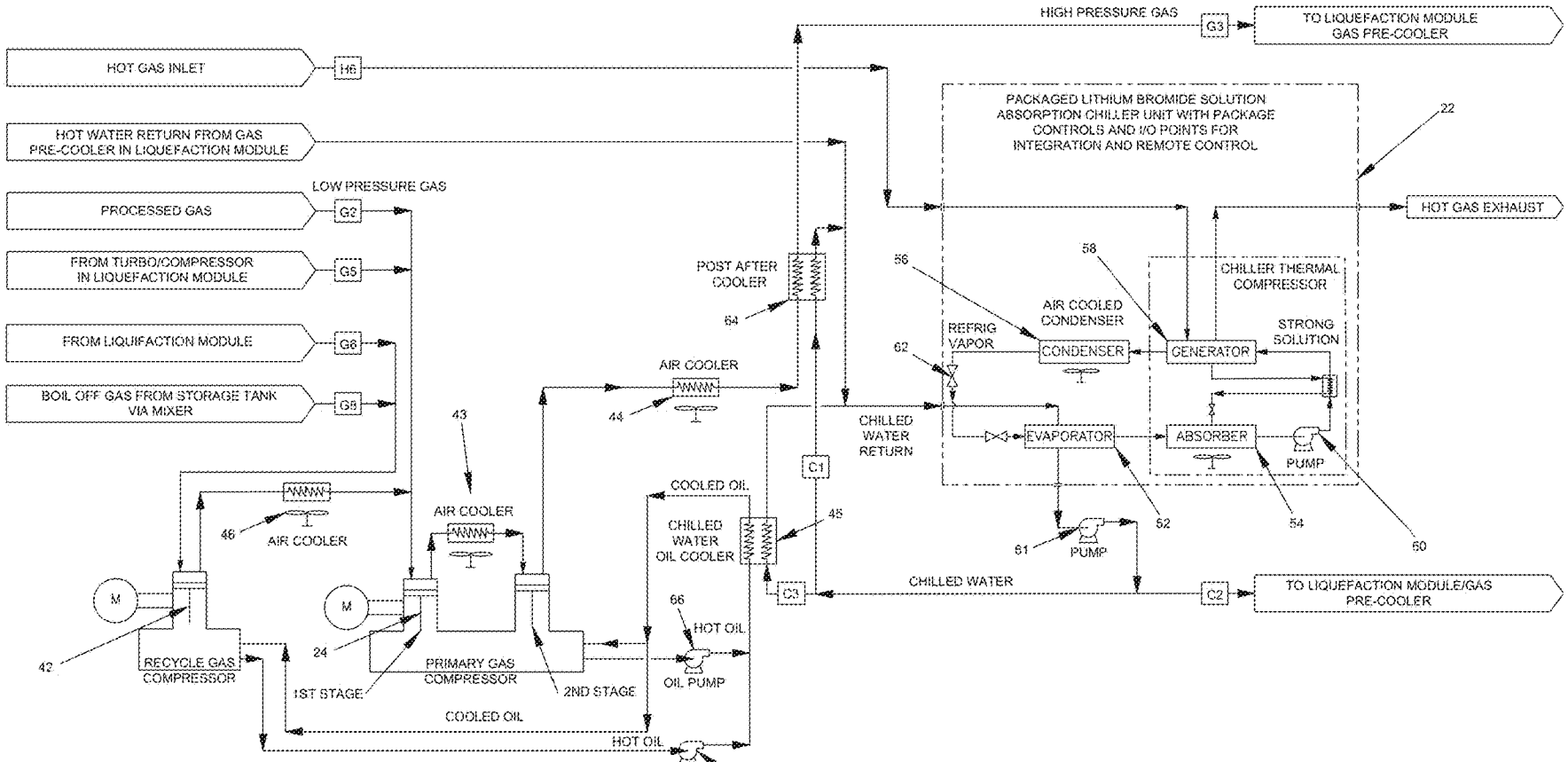
FIGURE 8: COMPRESSION MODULE

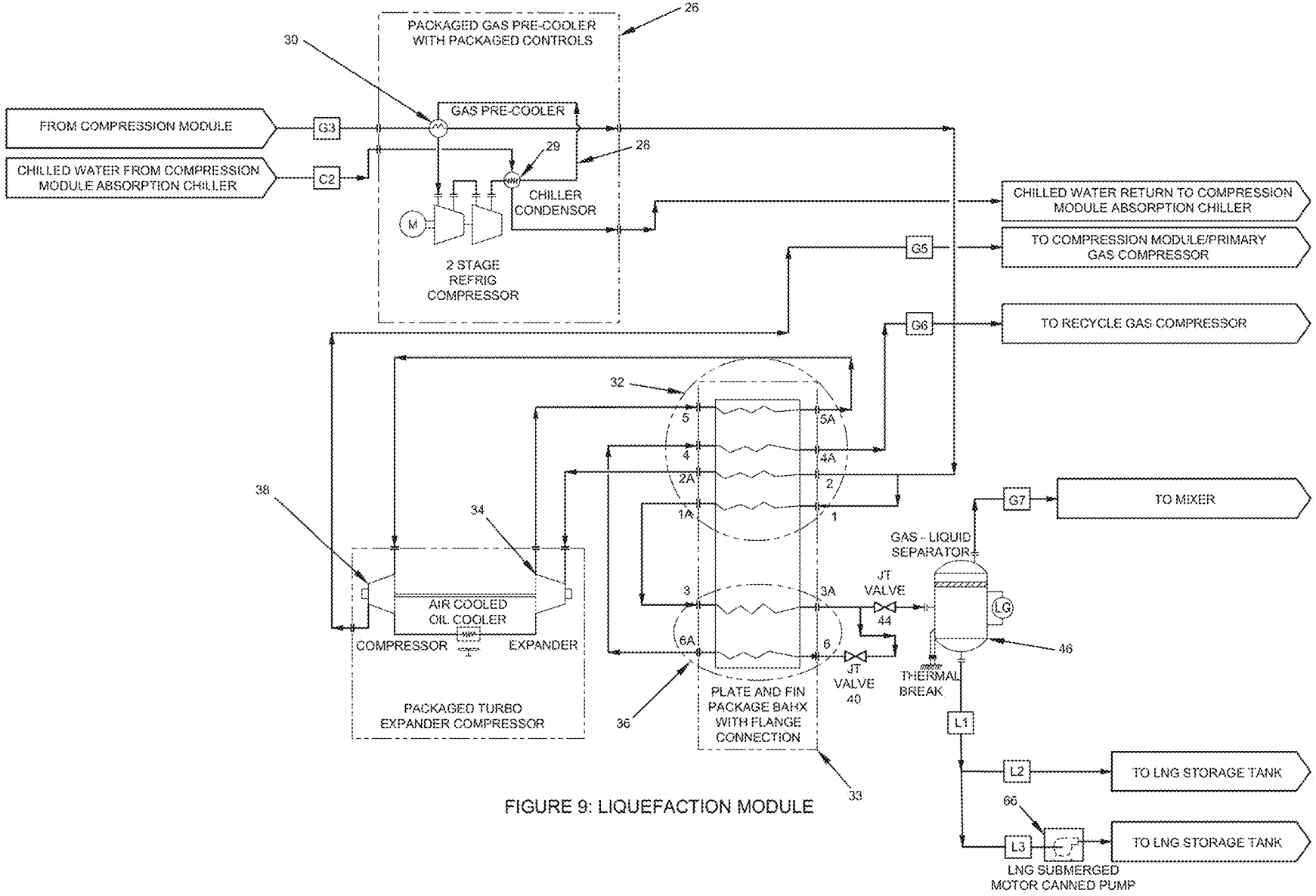
FIGURE 9: LIQUEFACTION MODULE

MODULAR, MOBILE AND SCALABLE LNG PLANT

CROSS-REFERENCE TO RELATED APPLICATION

This application claims the benefit under 35 U.S.C. § 119(e) of the earlier filing date of U.S. Provisional Patent Application No. 62/262,970 filed on Dec. 4, 2015, the disclosure of which is incorporated by reference herein.

BACKGROUND

This application discloses an invention which is related, generally and in various embodiments, to the conversion of liquefied natural gas from raw gaseous natural gas.

Liquefied natural gas (LNG) is raw gaseous natural gas that has been pre-processed to remove unwanted impurities and cooled to a liquid state for storage, shipping and further use. Typical processes for the production of liquefied natural gas from raw natural gas include a natural gas pre-treatment stage, a gas compression stage, and a gas liquefaction stage. The pre-treatment stage is required to remove inherent impurities such as carbon dioxide, heavy hydrocarbons, mercury and water to yield a product (LNG) that is primarily methane, usually of the order of 85% methane or better. This is necessary since the impurities have thermodynamic properties which can severely encumber the gas liquefaction process if they are not removed. The gas compression stage is achieved through the use of compressors which can vary in types. Generally positive displacement type compressors are employed and screw types and reciprocating types are generally preferred. Traditionally, the gas liquefaction stage requires the use of Mixed Refrigerant (MR), Nitrogen, Carbon Dioxides or other fluids to serve as the cooling medium or refrigerant in an independent refrigeration cycle employed as part of the gas liquefaction process. These refrigerants operate in closed loops, i.e. no refrigerant is theoretically consumed in these refrigeration cycles. Practically, the compressors and seal systems used in these refrigeration cycles are not completely leak tight and some amount of refrigerant will leak from the refrigeration cycle during the gas liquefaction process. Consequently, for all these refrigeration cycles the leaked refrigerant must be replaced by adding "make-up" refrigerant to the cycle. The "make-up" system involves providing the make-up refrigerant and the additional equipment required for handling this extra refrigerant, all of which adds cost and negatively impacts the refrigeration cycle efficiency and hence the liquefaction process efficiency. The use of hermetically sealed compressors, which exhibits zero refrigerant loss, has been considered for traditional systems but when compared to the cost of "make-up" components and other operating considerations including serviceability these have not been found to be economically advantageous compared to compressors utilizing mechanical seals.

Following gas compression and liquefaction, the liquid gas is then stored in well-insulated storage tanks or vessels designed to keep the cold boiling liquid at its liquid temperature.

Using LNG quality gas as a refrigerant in the production of LNG has been explored as a viable alternative to traditional refrigerants such as described in above. This interest is fueled by the fact that no make-up refrigerant or additional equipment would be required if LNG quality gas was employed as the refrigerant in the liquefaction process. This concept has been employed in small scale LNG production applications (small scale LNG has been loosely defined as the production of LNG in quantities up to 100,000 gallons per day), and there is at least one design that is based on this concept. LNG production systems utilizing LNG quality gas as a refrigerant faces the daunting task of achieving industry established standard LNG temperature (−260° F.) at atmospheric pressure. This is because of the challenge posed in using a gas to cool itself to its liquid temperature. To date, and with the exception of this invention which produces LNG at −259.1° F. at atmospheric pressure, no small scale system utilizing LNG quality gas as a refrigerant has been able to produce LNG this close to the industry standard LNG temperature and pressure ("standard LNG").

Contrary to arguments put forward by some equipment designers and vendors that LNG does not have to meet this standard condition to be acceptable, the industry that uses LNG almost always desires LNG that is, or at most one or two degrees from, −260° F. In addition, the colder the LNG the greater the energy density which is a preferential state and the primary motivation for desiring to liquefy the gas. It is true that achieving standard LNG conditions of temperature and pressure is difficult to realize, hence users of LNG oftentimes has little choice but to accept "warmer LNG for their operations. This invention overcomes this problem.

SUMMARY OF THE INVENTION

A process has been designed to convert 0.7 to 10 million standard cubic foot per day of raw (associated and/or non-associated) gaseous natural gas (NG) from a transmission source into liquefied natural gas (LNG), in quantities ranging from 7,000 to 100,000 gallons per day. The process equipment is mobile/modular/scalable (MMS), skid-mounted, and fully integrated to be placed at a suitable site for continuous operation with minimal supervision. Embodiments of the invention provide a mobile, modular and scalable (MMS) system for the small scale production of LNG There are several differences and advantages of this invention over typical systems, but the main ones include the following:

(1) System Configuration—All known engineered LNG production systems currently in operation essentially utilize the same type of equipment, namely a pre-process gas cleaning systems (typically a molecular sieve (mole sieve) or an amine system), gas compressors, expansion devices (which can be Joule Thompson valves or turbo expanders), and refrigeration systems to serve as gas pre-coolers or after-coolers in the gas liquefaction process. The primary difference between these gas liquefaction systems is the manner in which the equipment are arranged or configured. This invention, while employing equipment commonly encountered in LNG production systems, also boasts a configuration that is different from all other known systems in operation or in development. This unique configuration allows the discretizing of various functional parts of the system for easy fabrication and system production, uses less equipment, has a lower field installation time, and lower specific power compared to others. Discrete systems in this invention include the following:

(a) A gas pre-treatment unit—The gas treatment unit comprises a mole sieve system designed to remove impurities, including heavy components, carbon dioxide and water, from the feed gas stream. Clean gas (product gas) leaving the mole sieve is passed to the gas compression system and all waste or tail gas from the cleaning process are used wholly in other parts of the system (e.g. the power unit for providing power to the system).

(b) A gas pre-cooling system—This system employs a propane or propylene chiller which is used for pre-cooling the gas after it leaves the gas compressor unit. This stand-alone system provides cooling via a closed cycle lithium bromide absorption chiller unit which does not require "make-up" water for operation. This system design in this invention is unique and is not known to have been employed in small scale LNG production.

(c) A six stream heat exchanger unit—This system is uniquely designed to cool the product gas leaving the gas pre-cooler via fluid streams entering the exchanger from a turbo-expander, and from flash cooling resulting from thermal expansion of the gas via Joule Thompson valves. The configuration of this stand-alone heat exchanger, never before considered, is at the heart of the gas liquefaction process. It results in a simpler design, less equipment and piping, more efficient utilization of energy, and lower system cost.

(d) An absorption chiller unit—This stand-alone closed cycle lithium bromide absorption chiller unit utilize waste heat generated from the power generator unit to produce chilled water for equipment cooling. Due to its closed cycle design it requires no "make up" water system.

Since this chiller receives its energy from waste heat, the efficiency of the overall plant design is improved. Additionally, the fact that no water is required, the location for installation of the overall plant is independent of water for operations.

(e) A combined heat and power (CHP) unit—The entire liquefaction system is powered by a gas engine generator unit designed such that waste heat can be recovered for reuse. The fuel gas for the power unit is comprised of a mixture of source/pipeline gas and tail (also called waste gas) from the gas cleaning mole sieve unit.

(2) Gas Compression—This invention takes advantage of the lower specific power consumption associated with higher gas compression pressures up to about 870 psig for small scale LNG production systems as shown in FIG. 1. Known current systems either operate at low gas pressures of the order of about 400 psig or high pressures of the order of 5000 psig. However analysis shows that for small scale LNG systems, specific power decreases as gas pressure increase for systems operating from about 435 psig to about 870 psig. Taking this fact into account, this invention is designed to operate at a gas pressure of about 800 psig, well away from the 400's and much lower than 5000 psig.

(3) Heat Exchanger—A unique feature of this invention is the multi stream brazed aluminum heat exchanger (BAHX) design used in the liquefaction process. Typical natural gas liquefaction systems, even those utilizing BAHX, employ the common two and three stream exchangers in their liquefaction processes. The modelling of multistream cryogenic liquefaction systems poses a significant challenge to designers, and there are no known multipass exchanger in small scale LNG application that utilizes more than three streams. This invention models and uses a single six stream BAHX which reduces the number of process exchangers required in the liquefaction process, a significant reduction in equipment footprint and cost.

(4) LNG Specification—No known small scale LNG system currently in operation produces LNG at the temperature and pressure of −259.1° F. and one atmosphere respectively as this invention does. The closest reported temperature of other systems is more than 7° F. warmer which is significant in the LNG industry, especially if the LNG will be transported over long distances. While 7° F. degrees may seem small, overcoming this temperature difference to get to the ideal LNG temperature of −260° F. when using LNG quality gas as the system refrigerant is a significant improvement over other competing designs.

(5) Absorption Chilling and Waste Heat Reuse—Waste heat re-use to produce cooling is commonly used in thermodynamic systems to reduce energy cost. Nowadays, an additional consideration is waste heat reuse to reduce environmental impacts. Conventional refrigeration chillers have been used in small scale LNG applications. The refrigeration chillers are generally designed with air cooling systems or with water cooling systems. Systems utilizing water cooling are general designed with a cooling tower to dissipate the heat. Cooling tower systems require treated water, and a continual supply of "make-up" water to account for drift and evaporative water loss. With the exception of this invention, no existing system utilizes a closed cycle absorption chiller for producing refrigeration effects in a small scale LNG production system. In this invention, the absorption chiller can utilize waste heat from the power unit and a lithium bromide solution as a refrigerant to produce chilled water for equipment cooling and does not require the use of any water. Product gas does not come in direct contact with any fluid in the absorption chiller system. Due to the closed cycle design of the chiller, this low pressure, stand-alone absorption chiller system produces no emissions, and no drift or evaporative water loss from the system, and only minor heat dissipation.

The design of this LNG liquefaction process utilizing discrete, stand-alone functional containerized and/or skid mounted systems promotes the easy assembly and disassembly of the system. This is deliberately done such that the entire system can be fabricated in modules for ease of transportation and assembly wherever the system is required for operations. Additionally, multiple individual compression, pre-cooling, gas liquefaction and LNG storage systems can be connected to a single gas pretreatment unit, or be grouped in combination with identical systems as an expanded process to produce various quantities of LNG.

Given that the entire system is an assembly of discrete systems which can be fabricated in a wide range of location and transported to the site for quick assembly, and given that the system can be configured to yield different LNG capacities, the system is described as modular, mobile, and scalable. Multiple configurations of the gas process system are shown in FIG. 2 through FIG. 6.

The system has no process gases or liquids leave the process. The system provides connections/disconnections for power and system controls among the modules. The system has the ability to be discretely grouped in combination with identical systems as an expanded process to produce increased output of LNG.

BRIEF DESCRIPTION OF THE DRAWINGS

FIGS. 7A and 7B show a flow diagram of the MMS LNG plant according to an embodiment of the invention.

FIG. 8 shows a diagram of the compression/cooling system.

FIG. 9 shows a diagram of the liquefaction process.

DETAILED DESCRIPTION

Figure 1:
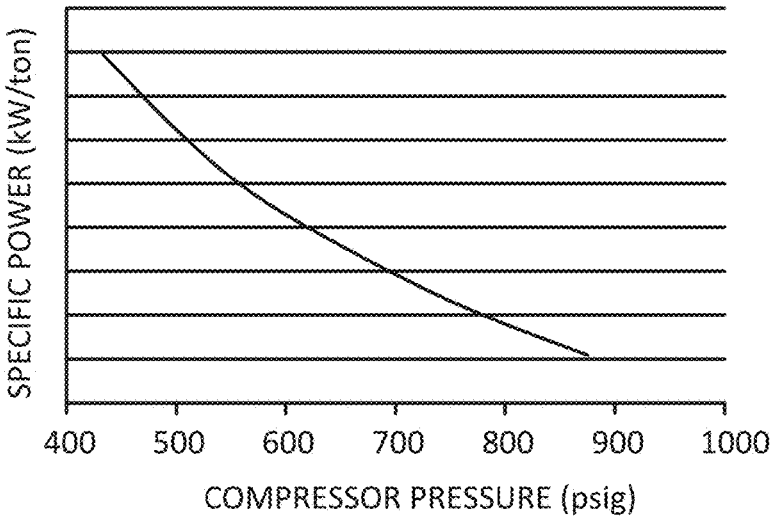
FIG. 1 is a graph showing liquefaction specific power vs compressor pressure for small scale LNG plants.
Figure 2:
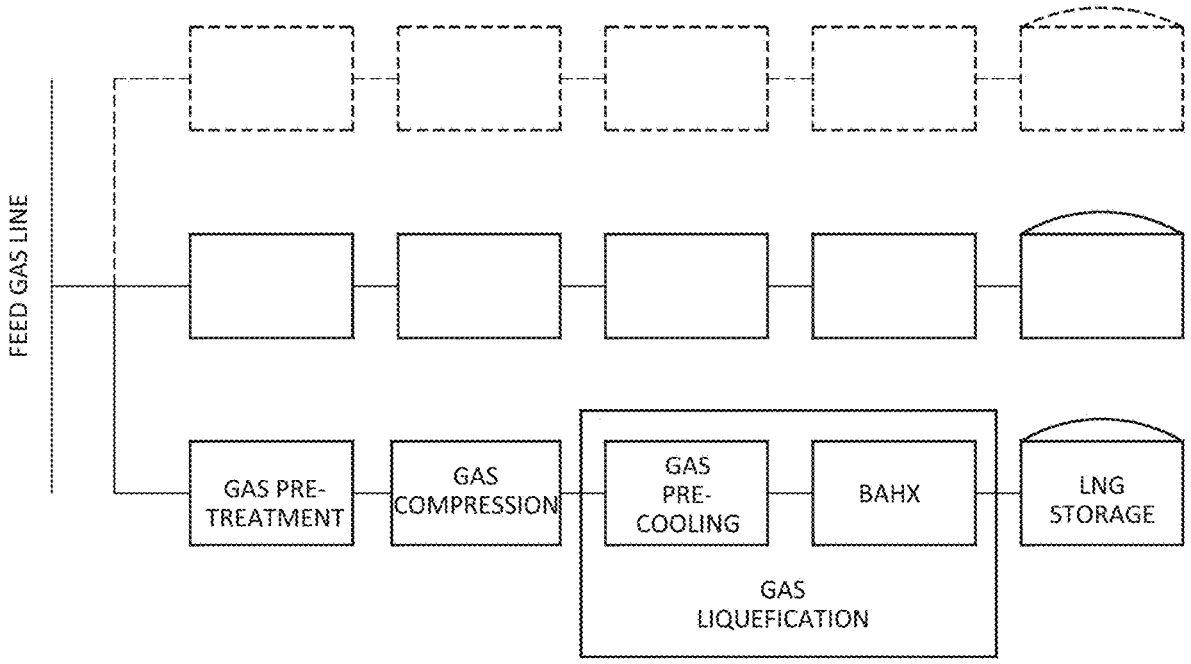
FIG. 2 shows a configuration of an embodiment of the system with multiple trains.
Figure 3:
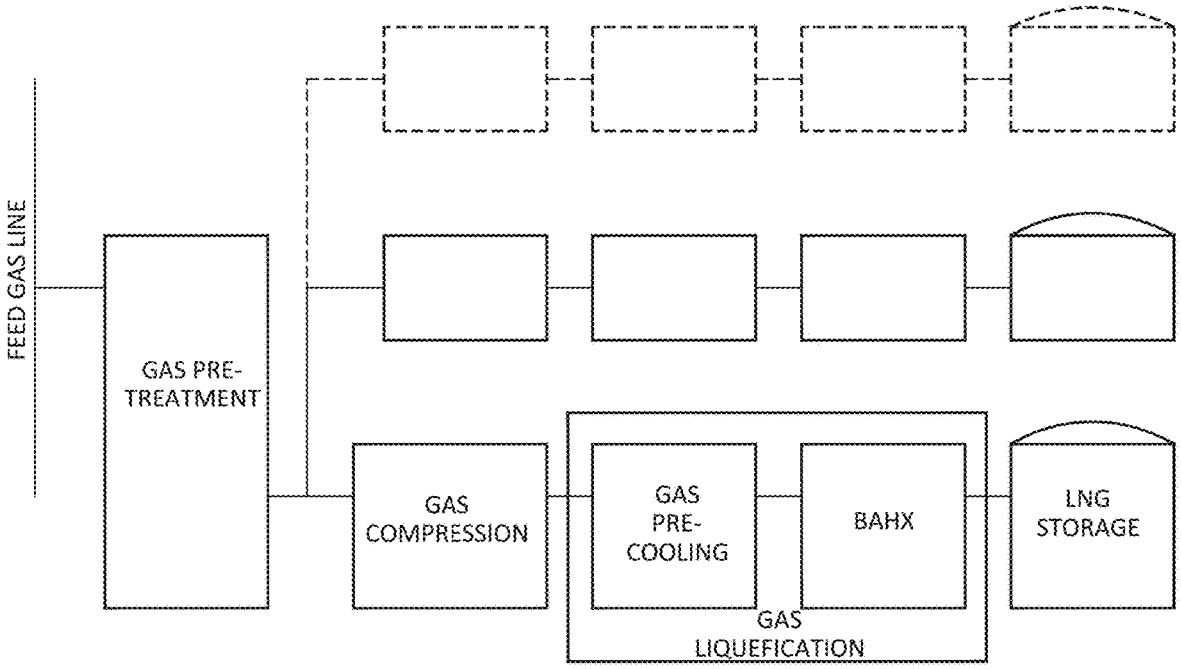
FIG. 3 shows a configuration of an embodiment of the system with one gas pre-treatment system and multiple compression, pre-cooling, liquefaction and LNG storage systems.
Figure 4:
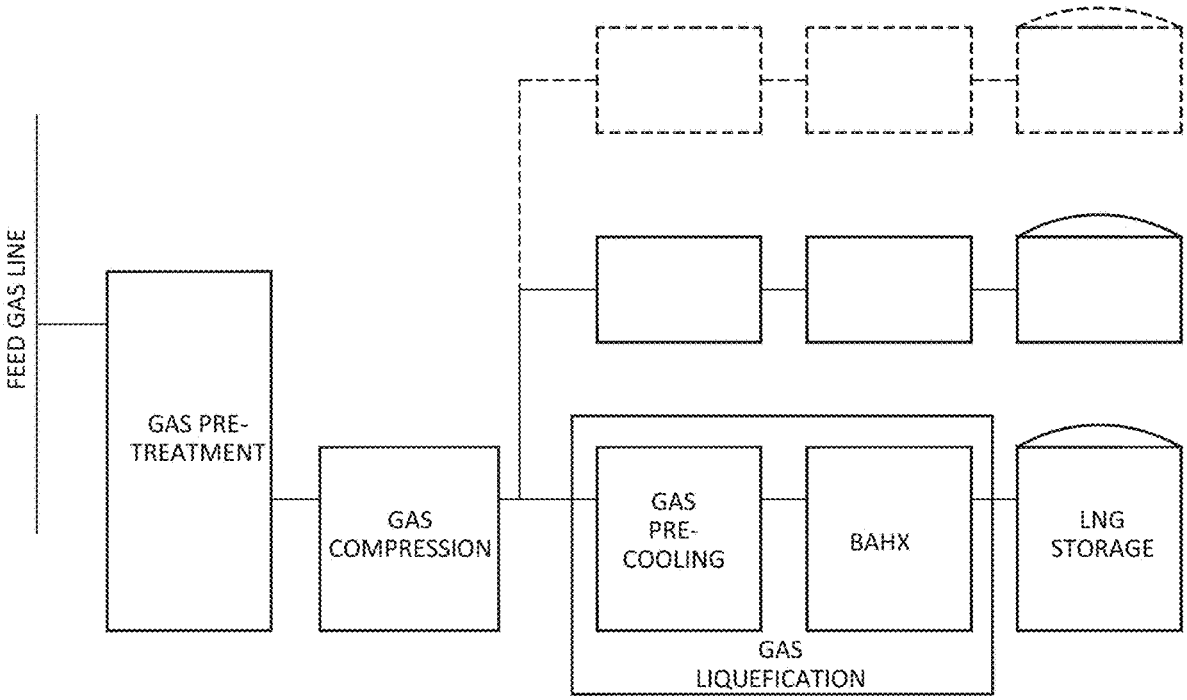
FIG. 4 shows a configuration of an embodiment of the system with one gas pre-treatment system, one compression system and multiple pre-cooling, gas liquefaction and LNG storage systems.
Figure 5:
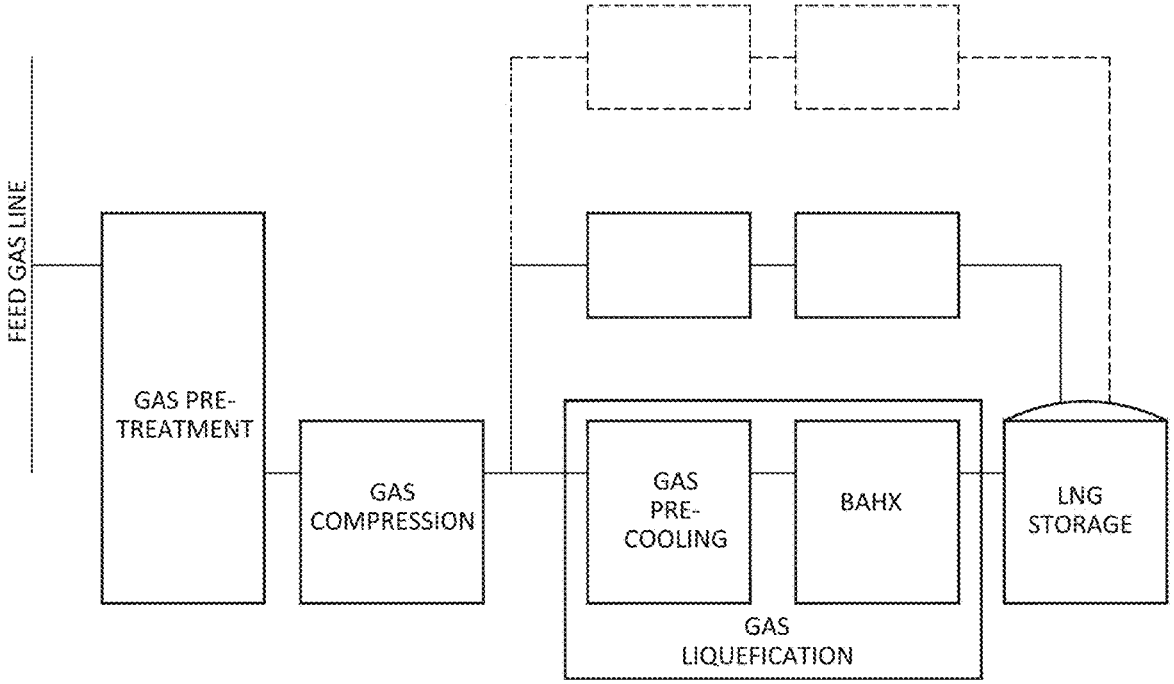
FIG. 5 shows a configuration of an embodiment of the system with one gas pre-treatment system, one compression system and multiple pre-cooling, gas liquefaction and one LNG storage systems.
Figure 6:
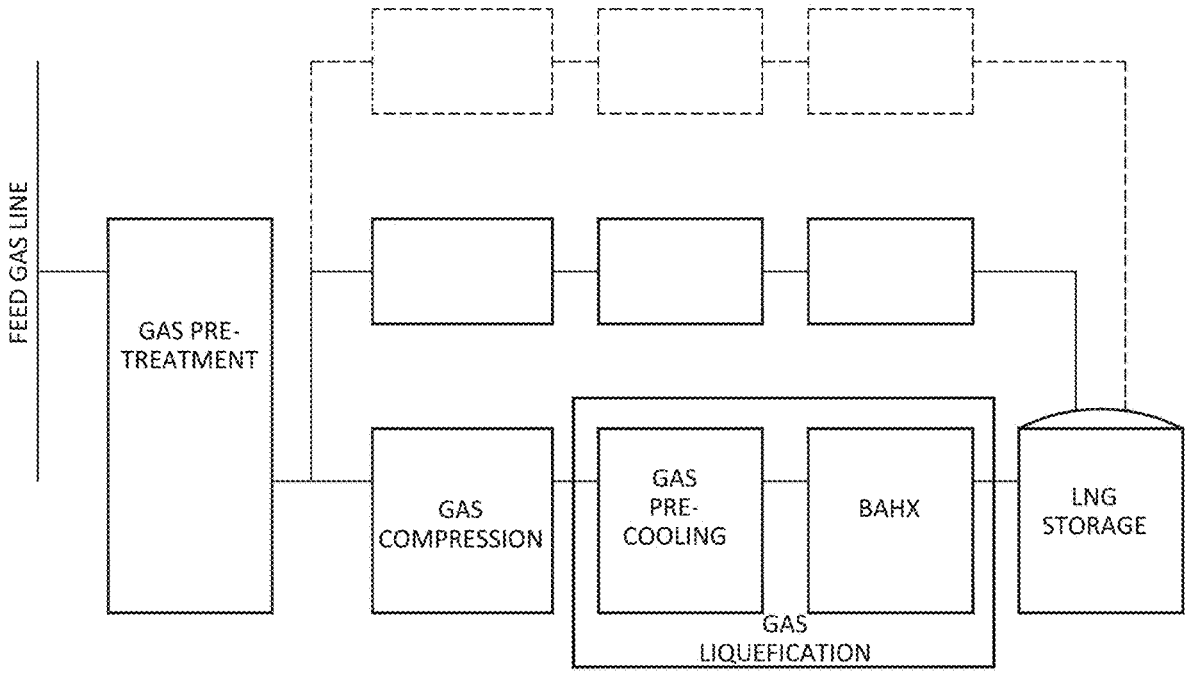
FIG. 6 shows shows a configuration of an embodiment of the system with one gas pre-treatment system, and multiple compression, pre-cooling, liquefaction and one LNG storage systems.

Conceptually, the system 10 (FIGS. 7A and 7B) includes either four or five modules comprising a gas pre-treatment module 12, a gas compression module 14 (see FIG. 8), a gas liquefaction module 16 (FIG. 9), an LNG storage module 18, and an optional power module 20. The power module 20 is designed such that it can provide electric power to the system via a gas engine or grid power or a combination of both, the selection being dependent upon available power at a site location and economics. Individual modules are wholly self-contained in a single enclosure or multiple enclosures, each enclosure capable of being transported by a truck.

NG G1 to be processed first enters the unit through the gas pre-treatment module 12 where it is pre-treated to remove inherent impurities such as carbon dioxide, heavy hydrocarbons, mercury and water. The natural gas supply G0 is a source of pipeline quality or boil-off (BOG) gas from LNG storage tanks or vessels, wherein the natural gas supplied to the pre-treatment module 12 has a carbon dioxide content of the order of 2 to 2.5 percent, saturated water, or water content of the order 50 to 100 ppm or less. The natural gas carbon dioxide content from the pre-treatment module 12 is of the order of ≤50 ppm and water content from the pre-treatment module 12 is of the order ≤1.0 ppm. The pre-treatment module 12 utilizes a pressure swing adsorption (PSA) micro-sieve technology using a molecular sieve which works continuously to remove impurities from the flowing gas stream. The resulting clean gas is primarily methane, suitable for liquefaction. The pre-treatment module 12 includes multiple tanks, and regenerates the treatment media in such a way that while some parts of the module are processing incoming gas, other parts are regenerating the media for reuse. The gas pre-treatment module is vendor-supplied in accordance with process equipment specifications. Pre-treatment module 12 is in fluid communication G2 with a multi-stage compressor 24, 42, in fluid communication with the natural gas supply G0, G1, and in fluid communication G4 with power module 20.

Following the pre-treatment module 12, the resulting gas stream G2 then enters the gas compression module 14 which includes an absorption chiller 22, and the multi-stage compressor including a primary gas compressor 24 and a recycle gas compressor 42. The primary gas compressor 24 compresses the gas stream to a pressure of about 800 psig to 934.7 psig to facilitate the remaining stages of the process. This pressure range of compression promotes the production of LNG at a low specific power consumption as can be observed from FIG. 1. The multi-stage compressor 24, 42 is in operational communication with the power module 20. The multi-stage compressor 24, 42 includes a first stage of recycle natural gas compression and two second stages of primary process compression. Inlet gas G2 provided to the first stage of primary natural gas compression is between 60° F. and 70° F. Leaving the first stage of primary gas compression at about 219° F., this gas then enters a first stage air intercooler 43 which cools the gas to between 100° F. and 110° F. In this temperature range of between 100° F. and 110° F., the gas then enters the second stage of primary natural gas compression. An inline natural gas first stage air cooler 43 (FIG. 8) is in fluid communication with the primary gas compressor 24 inter-stage discharge. An inline natural gas second stage air cooler 44 (FIG. 8) is in fluid communication with the primary gas compressor 24 final discharge (FIG. 8). After final discharge from the second stage of the primary gas compressor, the gas is fed to an absorption chiller 22 via a chilled water heat exchanger 45. Pre-treatment module 12 is in fluid communication G2 with the multi-stage compressor 24, 42 first stage inlet, in fluid communication with the natural gas supply G0, G1, and in fluid communication G4 with power module 20.

Referring to FIG. 8, absorption chiller 22 in gas compression module 14 (see FIG. 7A) provides chilled water to be used for equipment cooling. Absorption chiller 22 is a closed-cycle air cooled lithium bromide solution chiller which includes an evaporator 52, an absorber 54, a condenser 56, a generator 58, and a solution pump 60. Hot gas H6 (FIG. 8) is fed into the generator 58 which heats the high pressure lithium bromide and water solution. The high pressure hot lithium bromide solution allows the refrigerant (water vapor) to be fed into an air cooled condenser 56 where it is air cooled to form a high pressure cooled liquid. This high pressure cooled liquid is then passed through an expansion valve 62 which changes the liquid to a low pressure cold liquid on exit from the valve 62. The cold, low pressure, refrigerant liquid leaving the expansion valve 62 flows into the evaporator 52 which, through the process of heat exchange, cools the return hot water from the propane gas pre-cooler and cools the return hot water from oil cooler serving the primary and recycle gas compressors. Following this heat exchange, the refrigerant become vaporized and is caused to flow into the air cooled absorber 54 where it is cooled to form a low pressure cooled liquid. This low pressure liquid (water) is then re-absorbed into the lithium bromide solution in the absorber 54 which is replenished from the generator. The cooled, low pressure liquid solution is pumped by solution pump 60 to a high pressure and sent through the generator 58 to repeat the cooling cycle.

The return hot water leaves the evaporator 52 sufficiently cold to be used for equipment cooling. Hot waste gas from the gas engine, if provided, or direct fired heaters supplies the thermal energy required for absorption chiller 22 (FIG. 8) to provide the chilled water. Absorption chiller 22 (FIG. 7A) is in waste heat communication from with power module 20 (FIG. 7A) and is used to produce chilled water for cooling a post after cooler 64 (FIG. 8), a condenser 29 (FIG. 9) of a closed cycle propane pre-cooler 26 (FIG. 9). The closed-cycle propane natural gas pre-cooler 26 (FIG. 9) is in conjunction with a fluid-bath heat exchanger 30 (FIG. 9).

Figure 7A:
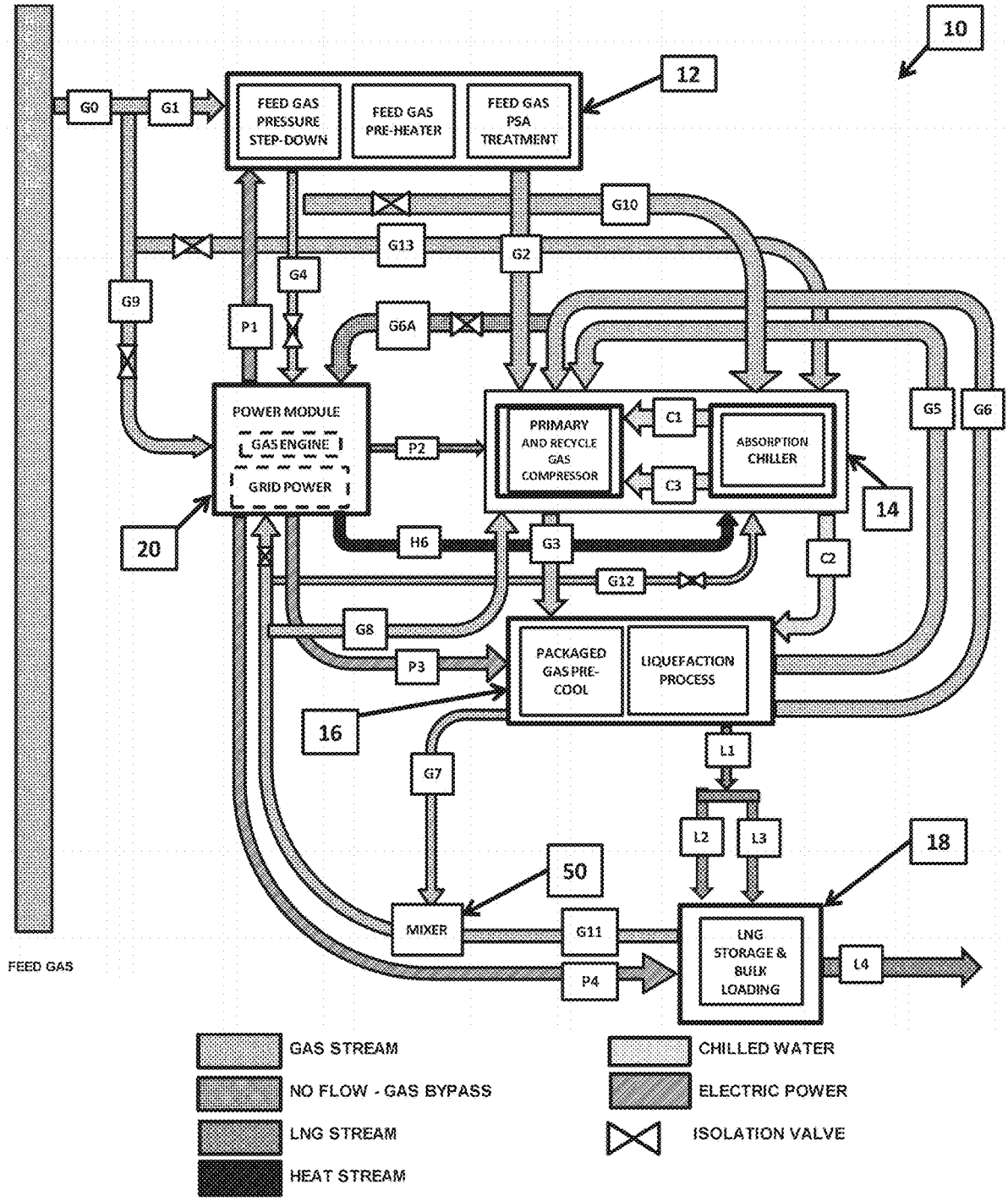

Following the gas compression module 14 (FIG. 7A), the pre-treated and compressed gas stream G3 then enters the gas liquefaction module 16 (FIG. 7A). To liquefy the pre-treated and compressed gas stream, the gas is cooled in three stages. The first stage of cooling (FIG. 9) is performed in the propane or propylene gas pre-cooler 26 (FIG. 9) which cools the approximately 800 psig gas G3 from about 54° F. to about −34° F. using a closed-loop refrigeration cycle 28 (FIG. 9). The gas pre-cooler 26 (FIG. 9) cools the gas via heat exchange with the refrigerant in a flooded-bath and tube heat exchanger 30 (FIG. 9). The second stage of cooling (FIG. 9) is achieved using the primary section 32 (FIG. 9) of the six-stream plate and fin heat exchanger 33 (FIG. 9) in conjunction with a turbo-expander 34. The cooled gas G8 leaving the gas pre-cooler 26 (FIG. 9) is first split into two streams and both streams are caused to enter the primary section 32 (FIG. 9) of the six stream plate and fin heat exchanger 33 (FIG. 9) via ports 1 and 2 (FIG. 9). Of these two streams, one (the refrigeration stream) enters and exits the exchanger at ports 2 and 2A (FIG. 9) respectively and is directed to the turbo expander 34 (FIG. 9) which rapidly reduces its pressure from about 800 psig to approximately 87 psig. The rapid reduction in pressure causes this stream to undergo a drop in temperature (to about −182° F.), producing a cooling or refrigeration effect. The remaining stream which enters port 1, exits the exchanger 33 (FIG. 9) at port 1A (FIG. 9) and is later separated to form a product stream and an additional self-cooling stream. The refrigeration stream after exiting the turbo expander as cold gas is re-directed back into the six stream exchanger 33 (FIG. 9), entering at port 5 (FIG. 9) and exiting at port 5A (FIG. 9) and in the process contributes to the cooling effect required for the effective operation of the exchanger 33 (FIG. 9). The other stream resulting from the split enters the exchanger 33 (FIG. 9) at port 1 and after exiting the primary section 32 (FIG. 9) at 1A of the six stream exchanger 33 (FIG. 9) is re-directed into the secondary section 36 (FIG. 9) via port 3 of the exchanger 33 (FIG. 9). The gas leaving port 3A (FIG. 9) of the exchanger 33 (FIG. 9) is further split into two streams on exit from the exchanger 33 (FIG. 9). One stream of the split is directed through a Joule Thompson (JT) valve 40 (FIG. 9) which lowers its pressure and subsequently its temperature to approximately −246.5° F. (now a two phase flow stream) to provide additional self-cooling of the gas. The remaining stream forms the product stream. The cold two phase fluid leaving the JT valve 40 (FIG. 9) is directed into the exchanger via port 6 to contribute to the cooling load of exchanger. The heat exchange between the fluid stream entering the exchanger via ports 6 (FIG. 9) and the other five streams in the exchanger 33 (FIG. 9) forms the third stage of cooling. The cold gas from the turbo-expander 34 (FIG. 9), after giving up its refrigeration effect in the plate and fin exchanger 33 (FIG. 9), enters a compressor (turbo-compressor) 38 (FIG. 9) where it is compressed and sent as make-up to the gas feed entering the first stage inlet of the primary gas compressor 24 (FIG. 8). The process stream resulting from the split after exiting the exchanger 33 (FIG. 9) from port 3A enters another JT valve 44 (FIG. 9) to undergo further temperature reduction in order to produce LNG. Cold two phase flow leaving from JT valve 40 (FIG. 9) after giving up its latent cooling effects in the exchanger 33 (FIG. 9) exits the exchanger 33 (FIG. 9) at port 6A and is further directed through the primary section 32 (FIG. 9) of the six stream plate and fin exchanger 33 (FIG. 9) via entry and exit ports 4 and 4A respectively in counter flow to the process flow to provide additional sensible cooling in the exchanger. Yielding up its cooling effect, the resulting warm stream (approximately −28° F.) low-pressure gas is directed to the recycle gas compressor 42 (FIG. 8). This compressor 42 appropriately elevates the pressure of this gas stream G6 and directs it to the inlet stage of the primary gas compressor 24 (FIG. 8). The cooled product stream (about −241° F.) is further directed through a second Joule-Thompson expansion valve 44 (FIG. 9) yielding a low pressure (about 14.7 to 17.5 psia), low-temperature (about −259.1° F. to −255° F.) two-phase cryogenic liquid/gas mixture. This two-phase mixture is fed into a gas-liquid separator 46 (FIG. 9) in fluid communication with one of the first and second Joule-Thompson valves 40, 44 (FIG. 9). Gas-liquid separator 46 separates the mixture into a liquid L1 and a gas G7 (FIG. 9). The LNG L1 is fed to the LNG storage tank 18 (FIG. 7A). The LNG can either be gravity fed into the tank via L2 (FIG. 9) or through the use of an inline submerged motor LNG canned pump 66 (FIG. 9) via L3 for further handling and dispensing L4 (FIG. 7A), and the separated or boil-off gas (BOG) gas G7 is fed to a mixer 50 where it is mixed with boil-off gas (BOG) G11 (FIG. 7A) from the LNG storage tank 18 (FIG. 7A). The gas leaving the mixer 50 is warmed under ambient conditions and fed to the power module 20 (FIG. 7A) as part of the fuel requirements for the gas engine, if provided. If required, the primary fuel source for the gas engine is the derived tail gas resulting from the gas pre-treatment PSA module 12. Power module 20 includes a prime mover in fluid communication with the natural gas supply G9, and in fluid communication with a mixture of dry natural gas G6A resulting from BOG gas G6 flow separation of cold natural gas resulting from vaporization of LNG in the LNG storage tank and LNG transfer vessels, and in fluid communication with carbon dioxide and water-rich natural gas G4 (FIG. 7A) from a molecular-sieve device of pre-treatment module 12.

The system 10 is designed such that when the power module 20 (FIG. 7A) utilizes a gas engine, it provides sufficient electric power to power all system equipment, and sufficient chilled water for equipment cooling needs. A water/glycol mix is chilled using the waste heat of combustion in a lithium bromide or similar performing solution based refrigeration circuit. When the power module 20 (FIG. 7A) does not utilize a gas engine, and instead utilizes grid power, the chiller is directly fired using tail gas G4 (FIG. 7A) from the pretreatment module 12 (FIG. 7A) as make-up fuel; the concept being to utilize the tail-gas in a beneficial manner, thus eliminating wasteful flaring as in other system designs. Referring to the Process Flows diagram (FIGS. 7A and 7B)—streams G4, G9, and G10, and G12 are regulated to supply the fuel necessary for the absorption chiller 22 (FIGS. 7A and 7B) when a gas engine power unit is not provided.

The storage module 18 (FIG. 7A) includes a single 15,000 LNG gallons double-walled, insulated vacuum-jacketed tank located at the end of the process cycle. The design is such that the storage module can comprise multiple storage tanks, and tank sizes are not limited to 15,000 LNG gallons. The storage tank keeps the liquid cold and its pressure low to minimize the boil-off rate. No NG in the process is vented or flared. The entire gas stream that enters the unit is either liquefied or burned as fuel in the power module 20 (FIG. 7A), and/or chiller unit.

The mass ratio of natural gas conversion to LNG to the amount used for powering the system 10 is about 0.85 to about 0.15, which is the most efficient process per available data in a "natural gas to natural gas liquefaction system."

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A system for the production of liquefied natural gas from raw natural gas comprising:

a pre-treatment module comprising a molecular sieve configured to remove impurities from a raw natural gas input;

a gas compression module comprising an absorption chiller, and a multi-stage compressor including a primary gas compressor and a recycle gas compressor configured to compress gas received from the pre-treatment module;

a gas liquefaction module comprising a gas pre-cooler configured to pre-cool gas received from the compression module using a closed-loop refrigeration cycle and a six-stream heat exchanger unit configured to cool gas received from the gas pre-cooler; and a power module comprising a gas engine configured to provide power to the gas compression module, and the gas liquefaction module, wherein the six-stream heat exchanger unit configured to cool gas received from the gas pre-cooler comprises a six-stream plate and fin heat exchanger, and wherein the six-stream plate and fin heat exchanger comprises a primary section and a secondary section, wherein the primary section is configured to receive first and second streams of gas from the gas pre-cooler, further comprising a turbo expander configured to receive the first stream of gas from the primary section of the six-stream plate and fin heat exchanger to reduce the pressure and temperature of the gas, wherein the secondary section is configured to receive a third stream of gas from the primary section, further comprising a first Joule Thompson valve configured to receive a first portion of the third stream of gas stream from the secondary section, wherein the primary section is configured to receive a fourth stream of gas from the secondary section, wherein the primary section is configured to receive a fifth stream of gas from the turbo expander, and wherein the secondary section is configured to receive a sixth stream of gas from the first Joule Thompson valve.

2. The system of claim 1, wherein the absorption chiller is configured to provide chilled water cooling to the compressed gas from the multi-stage compressor.

3. The system of claim 2, wherein the absorption chiller is a closed-cycle cooled lithium bromide solution chiller.

4. The system of claim 3, wherein the closed-cycle cooled lithium bromide solution chiller comprises:

an evaporator configured to cool return hot water received from the gas pre-cooler, wherein the evaporator is further configured to cool hot oil received from the primary and recycle gas compressors;

an absorber configured to cool water vapor received from the evaporator to form a low pressure cooled liquid which is reabsorbed into lithium bromide solution to form a cooled, low pressure liquid; and a solution pump configured for pumping the cooled, low pressure liquid through a generator to repeat the closed cycle.

5. The system of claim 4, wherein the compression module compresses the gas received from the pre-treatment module to a pressure of 800 psig to 934.7 psig.

6. The system of claim 1, wherein the gas pre-cooler of the gas liquefaction module comprises a propane or propylene chiller.

7. The system of claim 6, wherein the gas pre-cooler includes a flooded-bath and tube heat exchanger.

8. The system of claim 1, further comprising a second Joule Thompson valve configured to receive a second portion of the third stream of gas.

9. The system of claim 8, wherein the second portion of the third stream of gas from the second Joule Thompson valve has a pressure between 14.7 to 17.5 psia and a temperature between −259.1° F. to −255° F.

10. The system of claim 8, further comprising a gas-liquid separator configured to receive the second portion of the third stream of gas from the second Joule Thompson valve.

11. The system of claim 10, comprising a liquefied natural gas storage module configured to store liquefied natural gas received from the gas-liquid separator.

* * * * *